US011970312B2

(12) United States Patent
Behrend

(10) Patent No.: US 11,970,312 B2
(45) Date of Patent: Apr. 30, 2024

(54) CONTAINER CAP WITH A LINER RETENTION STRUCTURE

(71) Applicant: GlaxoSmithKline Consumer Healthcare Holdings (US) LLC, Wilmington, DE (US)

(72) Inventor: Grace A. Behrend, Warren, NJ (US)

(73) Assignee: HALEON US HOLDINGS LLC, Wilmington, DE (US)

( * ) Notice: Subject to any disclaimer, the term of this patent is extended or adjusted under 35 U.S.C. 154(b) by 0 days.

(21) Appl. No.: 16/767,708

(22) PCT Filed: Nov. 28, 2018

(86) PCT No.: PCT/US2018/062693
§ 371 (c)(1),
(2) Date: May 28, 2020

(87) PCT Pub. No.: WO2019/108562
PCT Pub. Date: Jun. 6, 2019

(65) Prior Publication Data

US 2020/0290779 A1 Sep. 17, 2020

Related U.S. Application Data

(60) Provisional application No. 62/592,622, filed on Nov. 30, 2017.

(51) Int. Cl.

| | |
|---|---|
| ***B65D 51/18*** | (2006.01) |
| ***B65D 41/48*** | (2006.01) |
| ***B65D 53/04*** | (2006.01) |

(52) U.S. Cl.
CPC ..... *B65D 41/48* (2013.01); *B65D 51/18* (2013.01); *B65D 53/04* (2013.01); *B65D 2251/0015* (2013.01); *B65D 2251/0093* (2013.01)

(58) Field of Classification Search
CPC ..... B65D 41/48; B65D 51/18; B65D 53/04; B65D 2251/0015; B65D 2251/0093;
(Continued)

(56) References Cited

U.S. PATENT DOCUMENTS

| | | | |
|---|---|---|---|
| 4,484,687 A | 11/1984 | Bullock, III | |
| 4,815,617 A | 3/1989 | Cullum | |

(Continued)

FOREIGN PATENT DOCUMENTS

| | | | | |
|---|---|---|---|---|
| BE | 890120 A | * 12/1981 | ..... | B65D 41/045 |
| CA | 2373390 C | * 1/2008 | ..... | B65D 41/08 |

(Continued)

*Primary Examiner* — Don M Anderson
*Assistant Examiner* — John Martin Hoppmann

(57) ABSTRACT

A cap for a container having a pair of side walls each with an inner wall surface. Each inner wall surface having a minimum of two pairs of ribs distributed thereon for retention of a liner. Each of the a minimum of two pairs of ribs has a concave arc with a concave radius of curvature forming a curved portion of the inner wall, and a convex arc. Each of the a minimum if two pairs of ribs has a different overall configuration that facilitates removal, and securing onto, of the cap from/to the container without damage of the ribs and the retention of the liner in the cap.

3 Claims, 14 Drawing Sheets

(58) Field of Classification Search
CPC ..... B65D 2543/0694–0703; B65D 2543/0805–0814
USPC ..... 220/780, 315, 324, 812, 317, 783, 788, 220/378; 222/570; 215/321, 318, 222, 215/252, 349–351, 211, 341
See application file for complete search history.

(56) References Cited

U.S. PATENT DOCUMENTS

| | | | | | |
|---|---|---|---|---|---|
| 4,967,921 | A * | 11/1990 | Pre | ..... | B65D 41/17 215/295 |
| 5,715,960 | A * | 2/1998 | Seymour | ..... | B65D 41/17 215/318 |
| 6,180,124 | B1 | 1/2001 | Ohta et al. | | |
| 2009/0045158 | A1 | 2/2009 | Suriol | | |

FOREIGN PATENT DOCUMENTS

| | | | | | |
|---|---|---|---|---|---|
| CN | 87102431 | A | | 10/1987 | |
| CN | 1119983 | C | | 9/2003 | |
| CN | 101801805 | A | | 8/2010 | |
| DE | 3130312 | | * | 12/1981 | ..... B65D 41/045 |
| EP | 0073334 | A1 | | 3/1983 | |
| EP | 0244049 | A2 | | 11/1987 | |
| EP | 0341949 | A1 | | 11/1989 | |
| FR | 2567104 | A1 | * | 1/1986 | ..... B65D 41/04 |
| WO | WO-2016195616 | A1 | * | 12/2016 | ..... B65D 51/246 |
| WO | WO-2017176396 | A1 | * | 10/2017 | ..... B65D 43/0277 |

* cited by examiner

CONTAINER CAP WITH A LINER RETENTION STRUCTURE

This application is a 371 of International Application No. PCT/US2018/062693, filed 28 Nov. 2018, which claims the benefit of U.S. Provisional Application No. 62/592,622, filed 30 Nov. 2017, which is incorporated herein in its entirety.

BACKGROUND

1. Field of the Disclosure

The present disclosure relates generally to container caps. More particularly, the present disclosure is related to break-resistant ribs located in a container cap that improves retention of a cap liner.

2. Description of Related Art

A cap for a container or bottle often needs a liner to seal the contents in the container once an original, safety seal is broken or removed from the container. Further, the cap will be repeatedly removed from the container during use and thus maintaining the liner securely in place is significant. Therefore, there is a need to maintain the integrity of the structure that retains the liner in place during repeated opening and closing of the cap on the container.

In addition, it is important to have such a cap that can be mass produced without defects or minimized defects in a large number of produced caps.

There is a present need to provide such a cap that addresses all of the above needs.

SUMMARY

The present disclosure provides a cap for a container having a retention system that holds the liner in place during opening and closing of the cap on the container without deterioration of the retention system.

The present disclosure also provides such a cap that can be produced in bulk, quickly and without damage to the structure for retaining the liner in the cap.

The present disclosure further provides an improved retention of the liner, yet enables the caps to be both manufactured and lined more efficiently.

The present disclosure still further provides such a cap for a container having a pair of curved side walls that are joined to each other. Each side wall has an outer wall surface and an inner wall surface, and each side wall extends around a center axis of the cap. The inner wall surface of each side wall has a plurality of ribs. Each rib has arcuate surfaces forming a curved structure on the inner wall surface and a curved surface in the latitudinal extant.

The present disclosure yet further provides that the radius of curvature of the ribs minimize breakage of the ribs when the cap is opened from and closed on the container.

The present disclosure also provides a preferred embodiment in which each side wall has three curved ribs and with each of the three curved ribs having a different configuration.

The present disclosure further provides such a preferred embodiment in which there are an additional pair of edge ribs and a pair of locking tabs located where the pair of side walls are joined.

The present disclosure still further provides that the application and retention of a liner is enhanced by the plurality of ribs having a radius of curvature since the shape of the ribs avoid breakage during continual opening and closing of the cap from the bottle.

The present disclosure also provides that in some embodiments, either alone or together with any one or more of the aforementioned embodiments, one or more fastening elements can be used to retain the liner in the cap.

The above-described and other features and advantages of the present disclosure will be appreciated and understood by those skilled in the art from the following detailed description, drawings, and appended claims.

DETAILED DESCRIPTION

Figure 1:
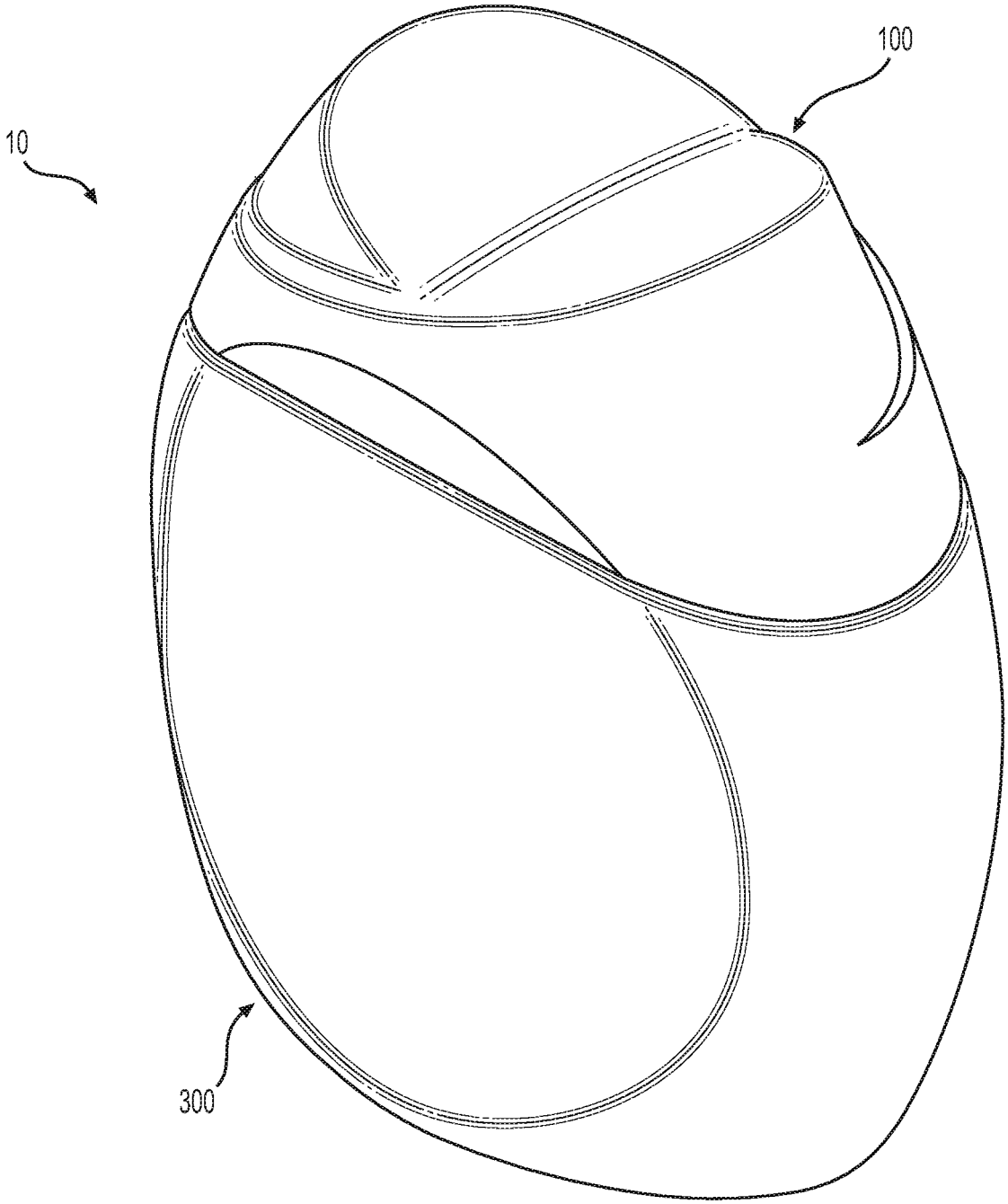
FIG. 1 is a front perspective view of an embodiment of a cap and bottle assembly according to the present disclosure.

Referring to the drawings and, in particular to FIG. 1, an exemplary embodiment of a cap and bottle assembly according to the present disclosure is shown and is generally referred to by reference numeral 10. Cap and bottle assembly 10 has a cap 100 and a bottle 300. Cap 100 is removably connected to bottle 300.

Figure 2:
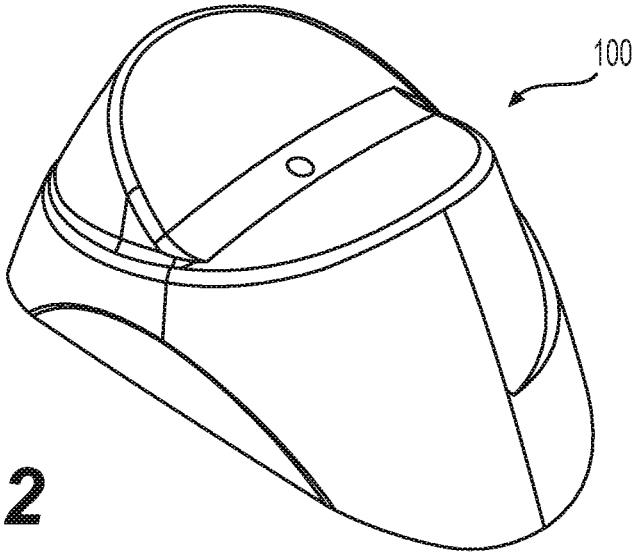
FIG. 2 is a front perspective view of the cap of FIG. 1.
Figure 3:
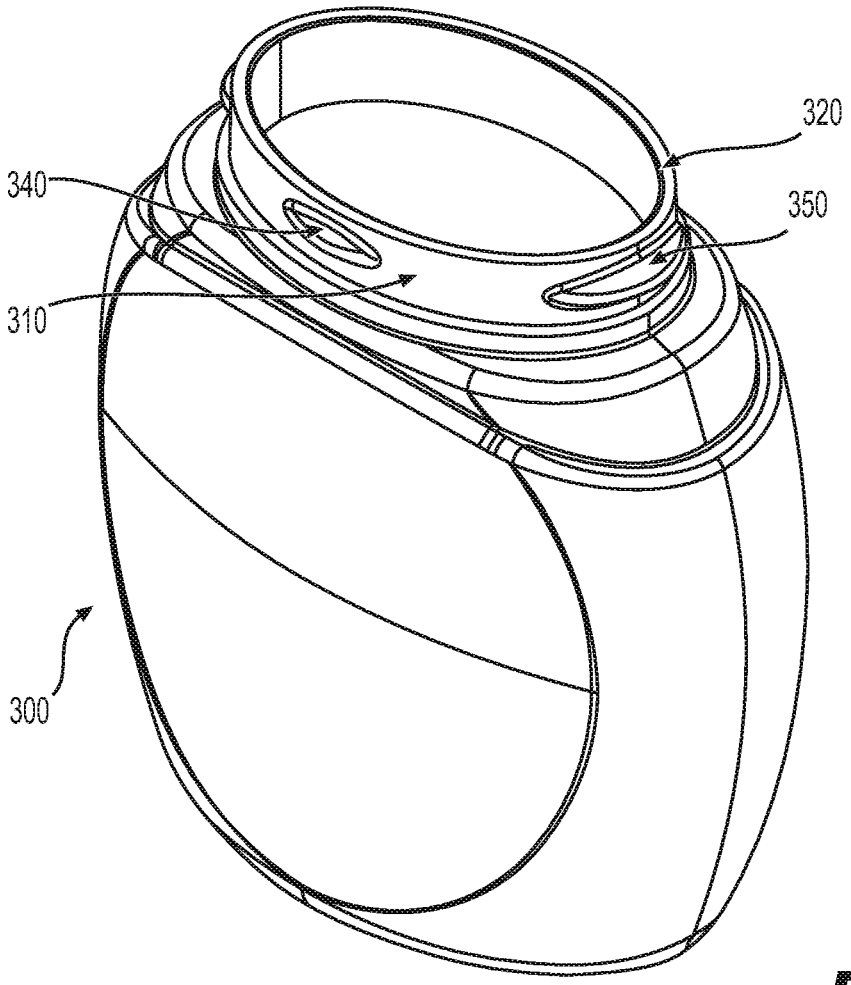
FIG. 3 is a front perspective view of the bottle used with the cap of FIG. 1.

FIG. 2 shows cap 100 of a preferred embodiment. FIG. 3 shows bottle 300 that can be used with cap 100. As noted bottle 300 has an upper neck portion 310 with a lip 320 having a plurality of flanges 340, 350 to receive cap 100.

Figure 4:
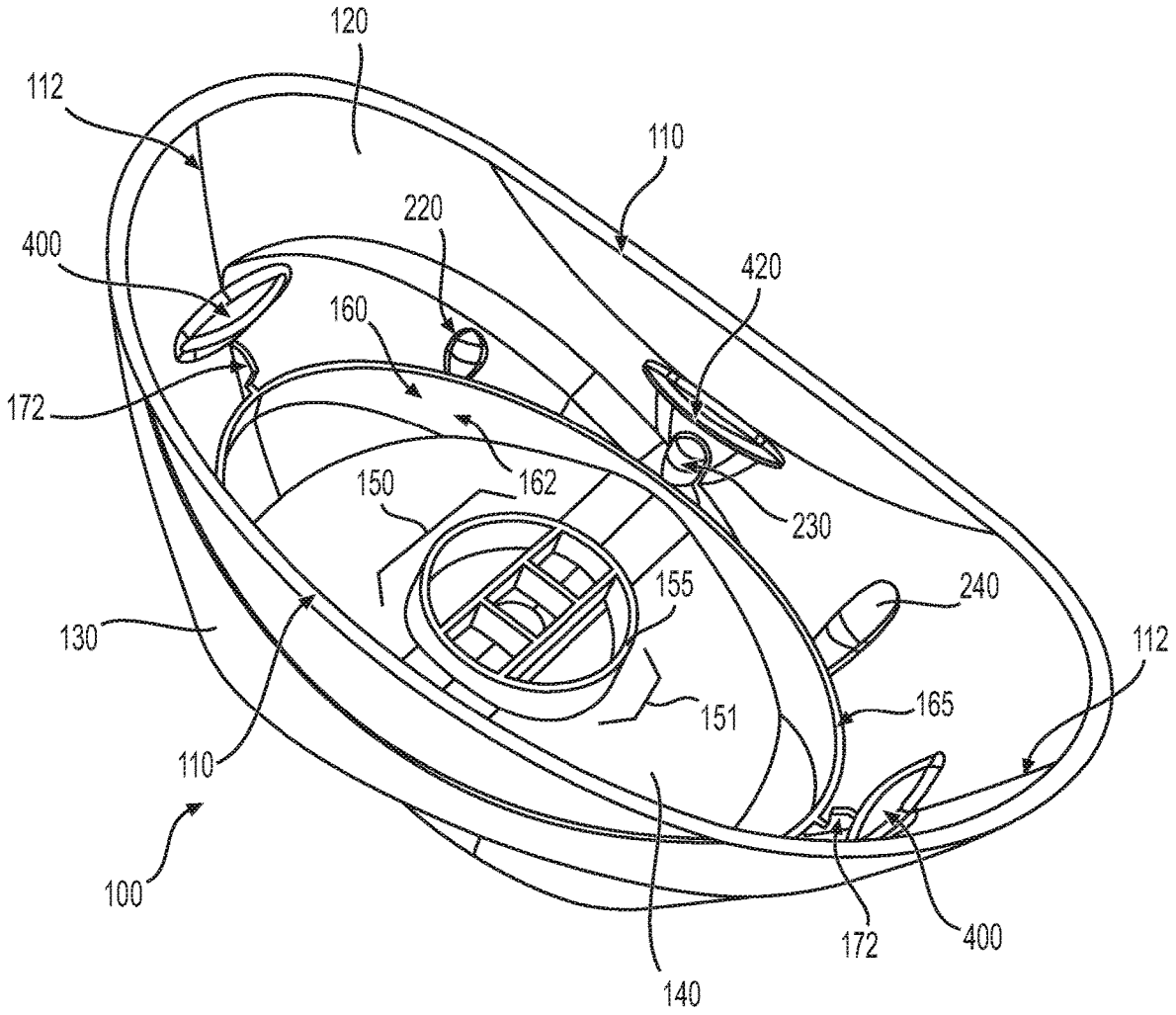
FIG. 4 is a bottom perspective view of the cap of FIG. 1.

Referring to FIG. 4, a preferred cap 100 has a pair of side walls 110 and an inner underside surface 140 that are joined together. It should be understood that the side wall 110 have an arcuate shape. However, the precise shape or configuration of side walls 110 can vary to form cap 100.

Each of the pair of side walls 110 has an inner wall surface 120 and an outer wall surface 130. Inner underside surface 140 preferably has a cup structure 150 in the center thereof, and preferably a circumferential rim 160 that intersects areas of inner underside surface 140 and an inner wall surface 120 as shown.

Cup structure 150 preferably has a circular shape with a height 151 and a top surface 155. As shown, circumferential rim 160 has an oblong shape that matches the contour of inner wall surface 120. Circumferential rim 160 preferably has an undulated wall structure 162 with a top surface 165. In a preferred embodiment, top surfaces 155 and 165 are coplanar.

As shown in FIG. 4, the pair of side walls 110 are joined or connected at edges 112. At each edge 112, there is an edge rib 172 and a first locking tab 400 that align latitudinally with each other.

Each of the two inner wall surfaces 120 has the same structure. Accordingly, one inner wall structure is described. Inner wall surface 120 has a plurality of ribs. Preferably, there are three side wall ribs, namely first side wall rib 220, second side wall rib 230 and third side wall rib 240. Also, each inner wall surface 120 has a second locking tab 420, preferably aligned latitudinally with second rib 230. Second locking tab 420 assists to selectively connect cap 100 to bottle 300.

Figure 5:
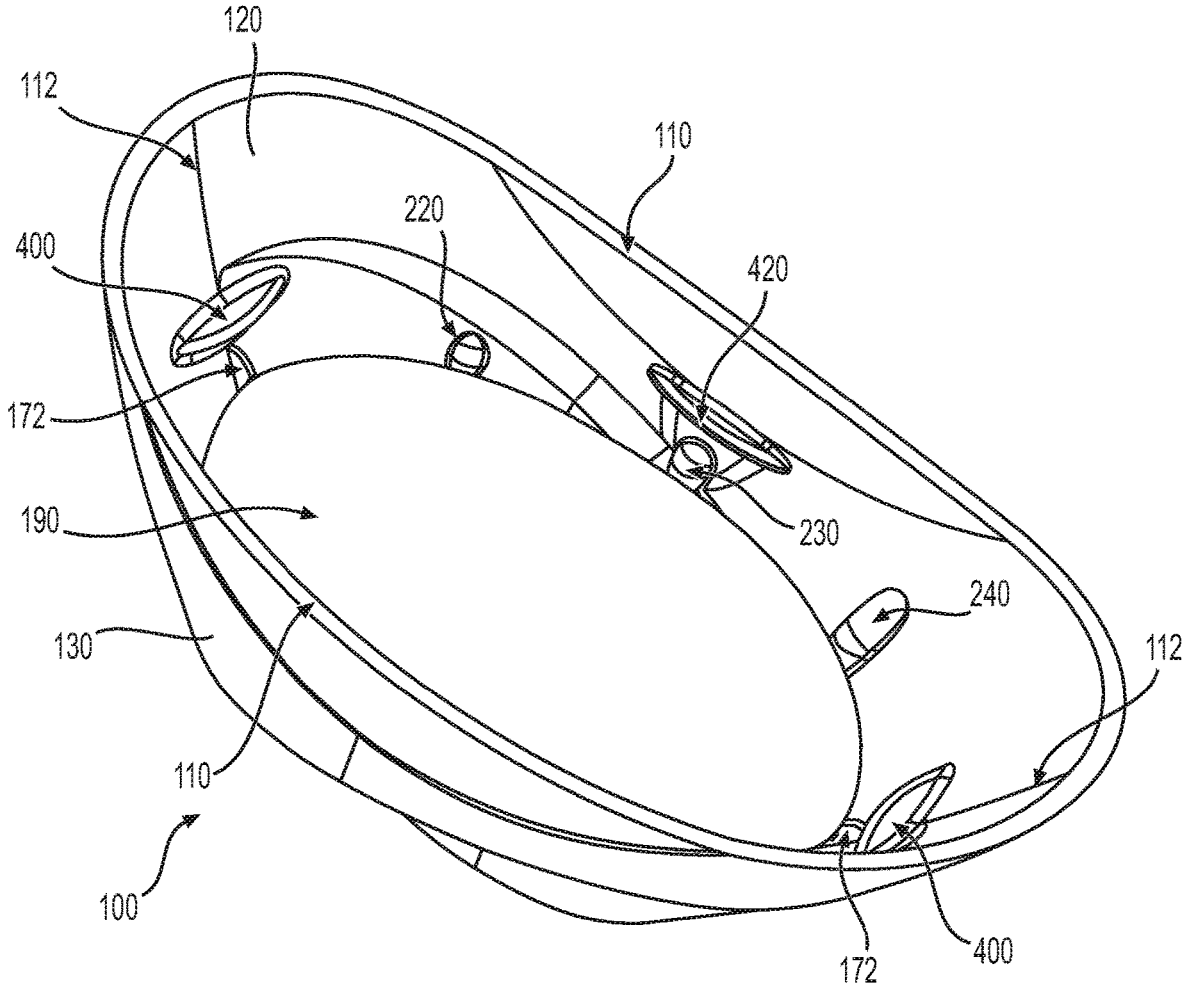
FIG. 5 is a bottom perspective view of the cap of FIG. 1 with a liner.

Referring to FIG. 5, an embodiment of cap 100 is shown with a liner, such as an induction liner 190. Induction liner 190 is inserted into cap 100 and contacts top surfaces 155 and 165. In some embodiments, fastening elements, such as but not limited to glue, can be used between any combination of top surfaces 155, 165 and induction liner 190. In some embodiments, fastening elements can be used between cup structure 150 and induction liner 190. One skilled in the art can use various fastening elements between appropriate surfaces of cap 100 and induction liner 190. A liner, such as Induction liner 190, has a generally elliptical shape, and has a major axis distance, along the axis of cap 100, and a minor axis distance that is perpendicular (latitudinal) to the major axis distance. The major axis distance is preferably about 50.65 millimeters ("mm"), and the minor axis distance is preferably about 34.05 mm.

As shown in FIG. 5, first, second and third ribs 220, 230, 240, respectively, and edge ribs 172 (thus all eight ribs from both edges 112 and both side walls 110) retain induction liner 190 once it is inserted into cap 100.

Figure 6:
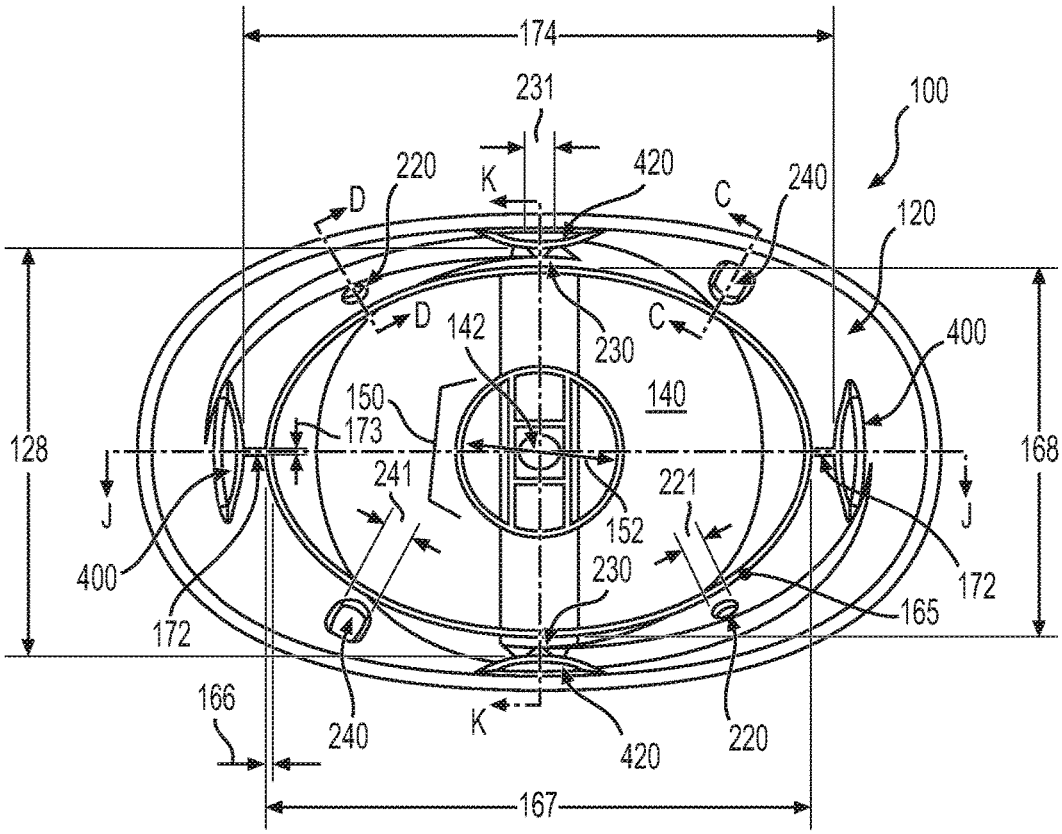
FIG. 6 is a bottom view of the cap of FIG. 1.

As shown in FIGS. 4-6, first, second and third ribs 220, 230 and 240, respectively, have a round radius thereby preventing breaking and shaving of the ribs that can occur when cap 100 is connected to, or disconnected, especially repeatedly from a bottle such as bottle 300. However, as discussed below, rib edge 172 and first, second and third ribs 220, 230 and 240, respectively, each has a slightly different configuration that is predicated based, in part, on their location on inner wall surface 120. The different configurations can include but are not limited to variations in height, depth, concave and convex radii of curvature, of which some embodiments are further described in FIGS. 7, 8 and 15. Thus, there are four different rib configurations twice along the inner wall surfaces 120 of cap 110.

It should be understood that due to the size and configuration of inner wall surface 120 and cap 100, it is envisioned that there can be as few as two side wall ribs and as many as five side wall ribs, per each half of cap 100.

Referring to FIG. 6, the two side walls 110 extend around central axis 142, that originates at the intersection of lines K-K and J-J, to form cap 100. Central axis 142 extends into the center of cup structure 150, and into surface 140, and to the outer surface 130 of cap 100. Cap 100 has a distance 174 that is measured between the innermost edge of first locking tabs 172. Cap 100 has a distance 128 that is measured between the innermost edges of second locking tabs 420.

In the embodiment shown, distance 174 is 53.62 mm, and distance 128 is 35.38 mm, with each distance 174, 128 plus or minus (±) 0.38 mm. Again, distances 174, 128 may vary slightly based in the configuration of cap 100 and the mating structure in bottle 300.

Figure 11:
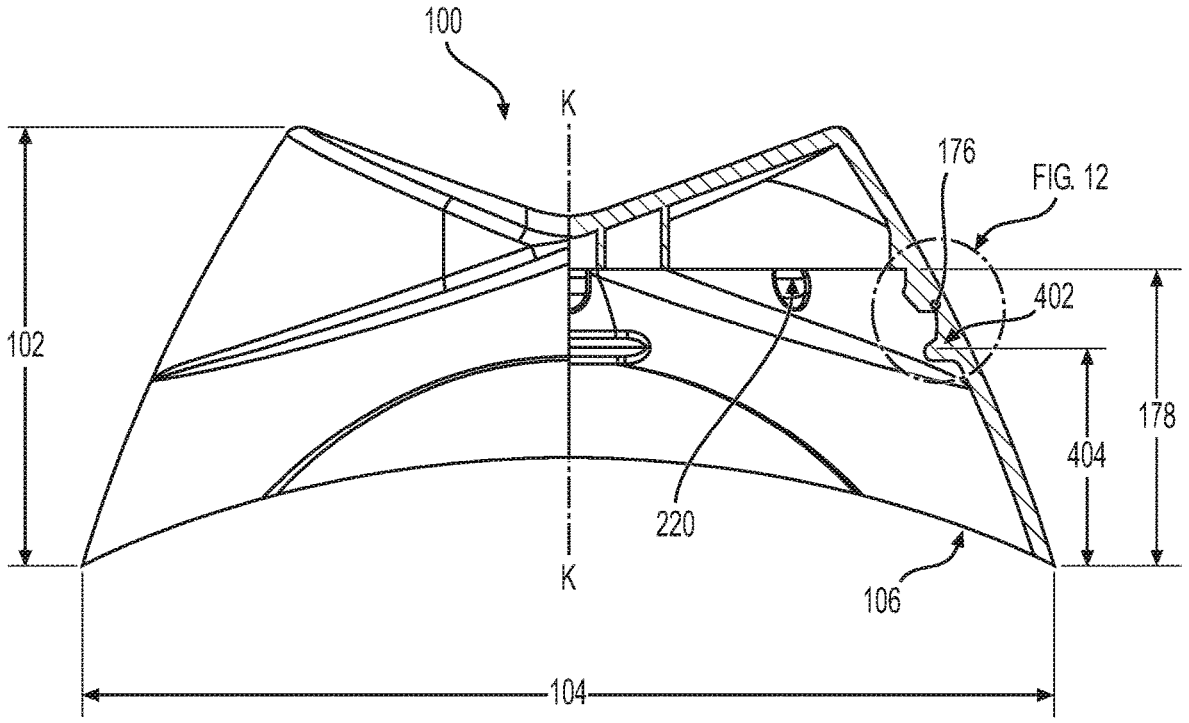
FIG. 11 is a partial front cross-sectional view of the cap of FIG. 9.

Referring to the cap embodiment shown in FIG. 11, cap 100 has a latitudinal extant or height 102 and an axial extant or length 104. The underside of cap 100 has a radius of curvature 106. The arc on the underside inner wall surface 120 is represented by radius of curvature 106 and can be defined by a circle with a center originating below cap 100. Cap 100 also has a latitudinal or vertical distance 404 that is measured from the lowest edge of cap 100 to first locking tab 400, and a vertical distance 178 that is measured from the lowest edge of cap 100 to edge rib 172.

In the cap embodiment shown in FIG. 11, height 102 is 29.21, and length 104 is 71.25 mm, again with each measurement ±0.38 mm. Radius of curvature 106 is preferably about 94.93 mm. Also, vertical distance 404 is preferably about 14.71 mm, and vertical distance 178 is preferably 19.15 mm±0.38 mm.

Figure 14:
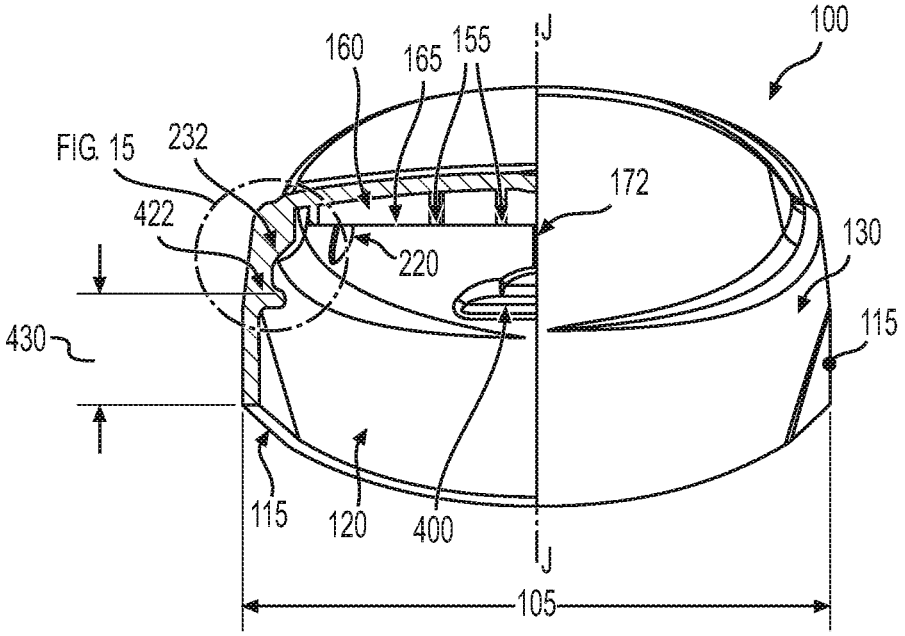
FIG. 14 is a side partial cross-sectional view taken along line K-K of the cap of FIG. 6, without a liner.

Referring to FIG. 14, cap 100 preferably has a draft 115 on outer wall surface 130. The draft 115 is symmetrically about line J-J shown in FIG. 6. Draft 115 is preferably about 1 degree.

Again, it should be understood that the dimensions set forth herein are for a preferred embodiment of cap 100. However, cap 100 and bottle 300 dimensions can vary based on the precise shape of the cap 100 and bottle 300. Notwithstanding, the dimensions of first, second and third ribs 220, 230, 240, respectively, may vary in height, diameter and depth, but such height, diameter and depth will not vary in proportion with respect to the radius of curvatures and slope dimensions of first, second and third ribs 220, 230, 240, respectively.

Referring again to FIG. 6, cup structure 150 has a diameter 152. Surface 165 of circumferential rim 160 has a width 166. Circumferential rim 160 has a major axis distance 167 and a minor axis distance 168, both measured along line K-K.

In the embodiment shown, diameter 152 is preferably about 15 mm, and width 166 is preferably about 0.51 mm. Major axis distance 167 is preferably 48.86 mm, and minor axis distance 168 is preferably 32.26 mm.

As will be discussed below, each one of edge ribs 172 is placed at an edge 112 and preferably aligns with one of the pair of first locking tabs 400. Also, edge rib 172 is closer than first locking tab 400 to underside surface 140. Edge rib 172 has a width 173. Width 173 is preferably 0.51 mm.

As shown in FIG. 6, first, second and third ribs 220, 230, 240, respectively, on one side wall 110 faces third, second and first ribs 240, 230 and 220, respectively on the other side wall 110. Also, in each side wall 110, second rib 230 is placed approximately mid-way on inner wall surface 120 and preferably aligns with one of the pair of second locking tabs 420. Also, second rib 230 is closer than second locking tab 420 to underside surface 140.

The alignment of edge ribs 172 and first locking tabs 400, and second ribs 230 and second locking tabs 420 are to reduce the number of areas on the inner wall surface 120 having abutments or protuberances from the inner wall surface 120. This structure results in easier manufacturing, and is believed to reduce the possibly of breakage of edge ribs 172 and second ribs 230 during normal use, namely twisting on and off of cap 100 from bottle 300.

There is a second less preferred embodiment of cap 100 in which there are only edge ribs 172 and two pairs of ribs, namely first ribs 220 and third ribs 240. Specifically, second ribs 230 that are believed to better secure induction liner 190 to cap 100 are missing, however in this embodiment second ribs 230 is not needed. In this embodiment, it is important that one first rib 220 on one inner wall surface 120 align longitudinal, namely perpendicular to the longitudinal axis of cap 100, and this longitudinal direction is parallel to line J-J of FIG. 6. Thus, the rib pattern about inner wall surface 120 starting from the leftmost edge rib 172 shown in FIG. 6, is one first rib 220, then one third rib 240, the other edge rib 172, the other first rib 220, the other third rib 240 and ending at leftmost edge rib 172.

Second rib 230 is positioned, preferably equidistant, between first rib 220 and third rib 240, and first rib 220 and third rib 240 is preferably the same distance from edge rib 172. Each of first, second and third ribs 220, 230, 240, respectively, has a different cross-sectional configuration as shown more clearly in FIGS. 7, 8 and 15, respectively. It should be noted that each first, second and third rib, 220, 230, 240 respectively, may each have a different concave radius of curvature, which after the apex of the curve, each rib 220, 230 and 240 curves in gradually toward inner wall 120 and in the direction of underside surface 140. Also, each of first, second and third ribs 220, 230, 240, respectively, has a different cross-sectional configuration than edge rib 172. Amongst the three side wall ribs, first rib 220 has a diameter 221. Second rib 230 has a diameter 231. Third rib 240 has a diameter 241. Preferably, first rib 220 has a diameter of about 2.14 mm, second rib 230 is about 2.74 mm, and third rib 240 is about 2.71 mm. Thus, second rib 230 has the largest diameter.

Figure 7:
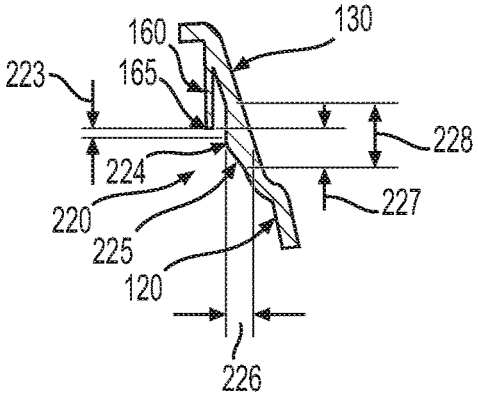
FIG. 7 is a cross-sectional view rotated 180 degrees counterclockwise of the rib taken along line D-D in the cap of FIG. 6.

Referring to FIG. 7, first rib 220 has basically a stepped inner and elongated slanted outer shape viewed cross-section. Specifically, first rib 220 has a depth 226, a height 228 and a convex radius of curvature 225. First rib 220 also forms a concave surface on inner wall surface 120 with a radius of curvature 224.

In the embodiment shown, depth 226 is preferably about 1.96 mm, height 228 is preferably about 4.51 mm, and radius of curvature 224 is preferably about 1.98 mm. Convex radius of curvature 225 is preferably about 19.05 mm.

Also shown in FIG. 7 is a vertical distance 227 that is a subset of height 228. Vertical distance 227 is measured from the bottom of first rib 220 to top surface of circumferential rim 165. There is also a distance 223 that is measured between cap 100 and a portion of first rib 220.

In the embodiment shown, vertical distance 227 is preferably about 2.76 mm. Distance 223 is preferably about 0.64 mm.

Figure 8:
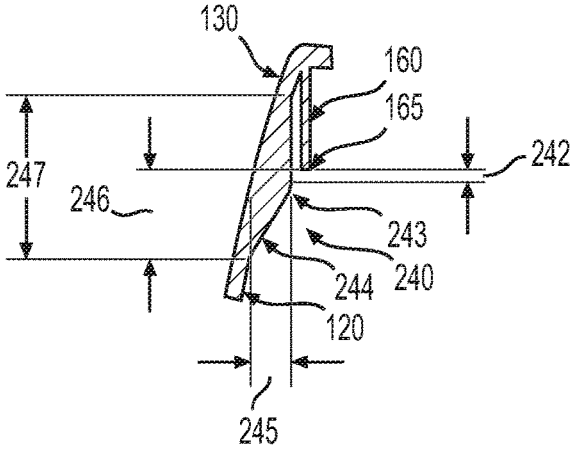
FIG. 8 is a cross-sectional view rotated 180 degrees clockwise of the rib taken along line C-C in the cap of FIG. 6.

Referring to FIG. 8, third rib 240, as shown in cross-section, has a straight surfaces inner, and elongated outer sloped, shape, that differs from the shape of first rib 220. Specifically, third rib 240, as shown in cross-section, has a depth 245, a height 247 and a concave surface with a concave radius of curvature 243. The concave surface of second rib 240 is formed on inner wall surface 120. Third rib 240 also has a convex arc. The convex arc is represented by the radius of curvature 244. Radius of curvature 244 can be measured as a circle with a center originating away from the outer wall surface 130 of side wall 110 to inner wall 120. The convex arc or radius of curvature 244 produces a slope that enhances the ease of application of a liner, such as induction liner 190, into cap 100.

As shown in this embodiment, depth 245 is preferably about 3.21 mm, and distance 247 is preferably about 10.07 mm. Also, concave radius of curvature 243 is preferably about 1.98 mm, and convex radius of curvature 244 is preferably about 19.05 mm.

Third rib 240 has a latitudinal or vertical distance 246, that is a subset of height 247. Height 246 is measured from top surface 165 to substantially the bottom of third rib 240. As shown in this embodiment, distance 246 is preferably about 5.46 mm. As also shown, cap 100 has a distance 242 that is preferably about 0.64 mm.

Figure 9:
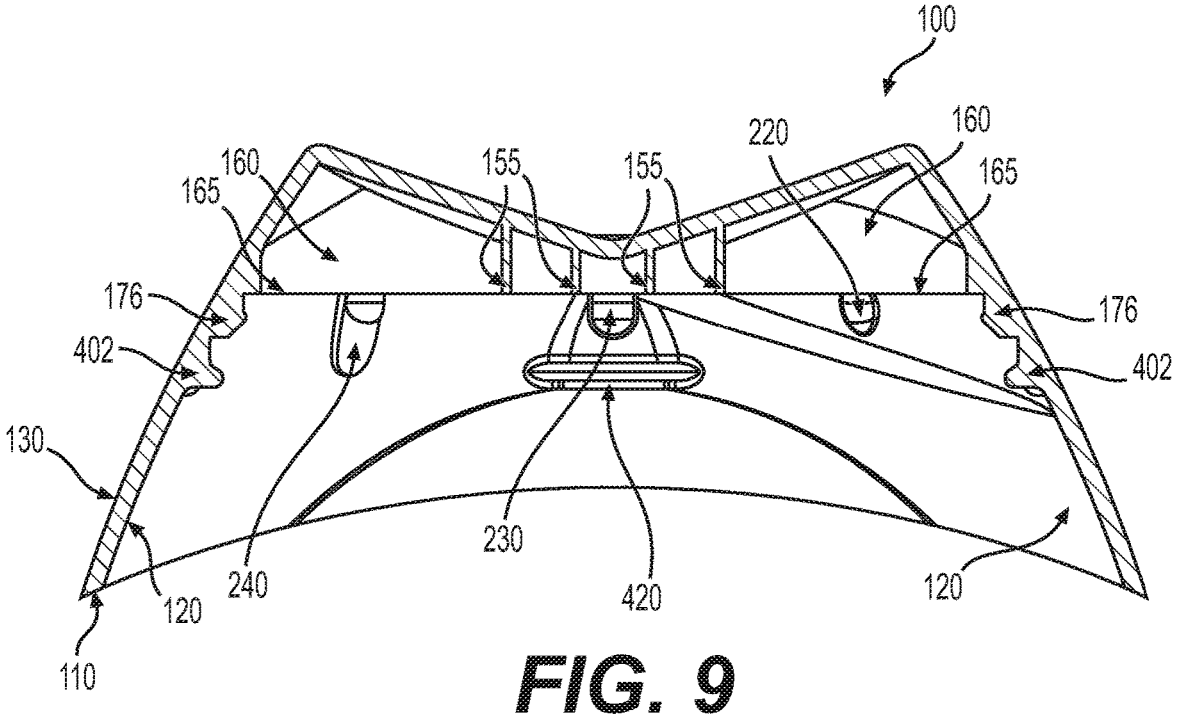
FIG. 9 is a front cross-sectional view taken along line J-J of the cap of FIG. 6.

Before proceeding with a description of second rib 230 shown in FIG. 15, edge rib 172, as well as first locking tab 400 will be discussed. FIG. 9 shows the cross-sectional areas 176 and 402 of edge rib 172 and first locking tab 400, respectively. As discussed above, cap 100 has two side walls 110 that meet at the two edges 112. Thus, each edge 112 has located thereat one edge rib 172 and one first locking tab 400.

FIG. 9 shows the structure of cap 100 without induction liner 190. The axial alignment of top surfaces 155, 165 are shown. Further, the alignment of the tops of edge ribs 172 (shown via cross-sectional area 176), and first, second and third ribs 220, 230 and 240, respectively, are also shown.

Each rib 220, 230, 240 has a slope that enhances the ease of application into and the retention in cap of induction liner 190. Advantageously, the entire structure of first, second and third ribs 220, 230, 240, respectively, provide enhanced ease of application and retention of induction liner 190. Further, the structure of cap 100 with edge rib 172 and first, second, third ribs 220, 230, 240, respectively, and their shape results in decreased production times of cap 100 and ease of inserting induction liner 190 into position in cap 100, thereby increasing manufacturing efficiency. Further, the configuration of first, second, third ribs 220, 230, 240, respectively, also withstand the friction caused by the twisting action during opening and closing of cap 100 on bottle 300.

Figure 10:
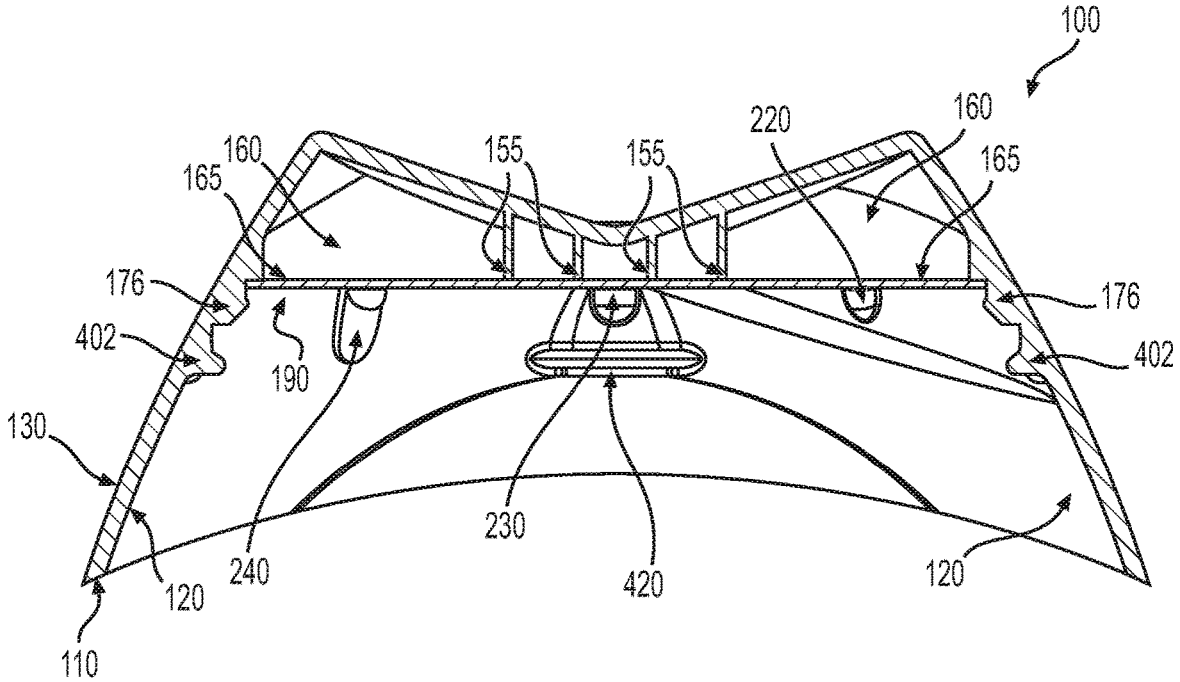
FIG. 10 is a front cross-sectional view taken along line J-J of the cap of FIG. 6, with a liner.

Referring to FIG. 10, when induction liner 190 is placed into cap 100 as shown, induction liner 190 contacts surfaces 155 and 165. In some embodiments, fastening elements are used between any combination of surfaces 155, 165 and 190, to further improve retention of induction liner 190 in cap 100. The fastening elements include, but are not limited to glue. The fastening element can be used on or in cup structure 150 and especially on top surface 155. The fastening elements can also be used on circumferential rim 160 especially on top surface 165, or in any combination thereof, with the contact surface of induction liner 190.

Figure 12:
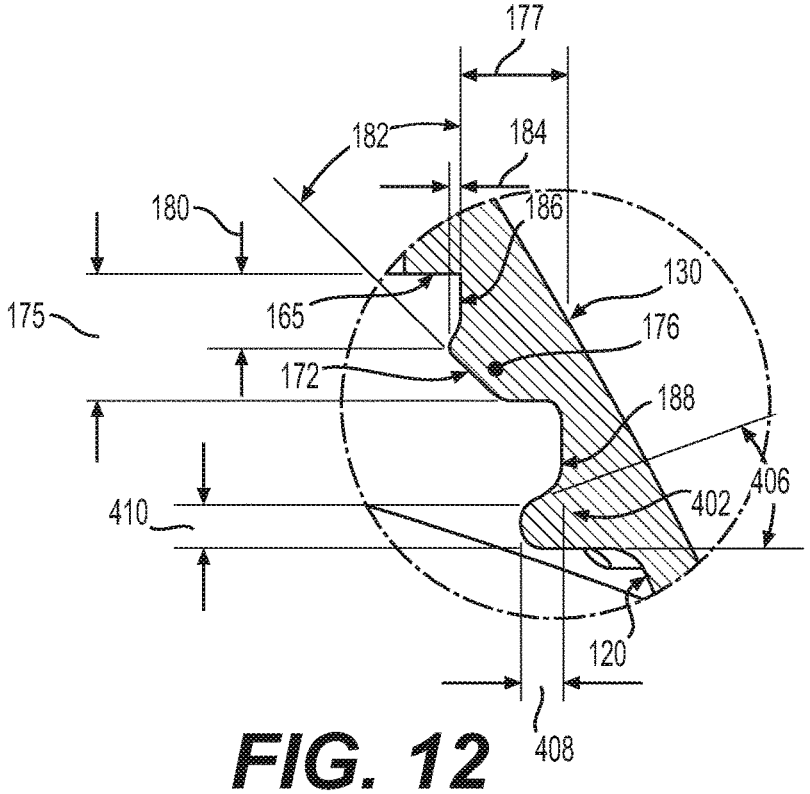
FIG. 12 is a cross sectional view of a rib taken along line J-J, in the dashed portion of FIG. 11.

FIG. 12 shows cross-sectional area 176 and 402 of edge rib 172 and first locking tab 400, respectively, taken along line J-J of FIG. 6. Edge rib 172 begins to slope at an angle 182 that begins at a distance 180 measured from surface 165. Edge rib 172 protrudes out at a distance 184 from a surface 186 that is perpendicular to surface 165. Edge rib 172 has a height 175 that is measured from surface 165 to substantially the bottom of edge rib 172. Edge rib 172 has a depth 177 that is measured from surface 186 to surface 130.

In the embodiment shown for edge rib 172, distance 180 is preferably about 1.65 mm, and distance 184 is preferably about 0.25 mm. Also, angle 182 is preferably about 45 degrees. Height 175 is preferably 2.92 mm. Depth 177 is preferably 2.37 mm.

First locking tab 400 protrudes out a distance 408 from a surface 188. First locking tab 400 has a height 410, and tapers at an angle 406. In the embodiment shown, distance 408 is preferably about 0.94 mm and height 410 is preferably about 0.97 mm. Angle 406 is preferably about 20 degrees.

Figure 13:
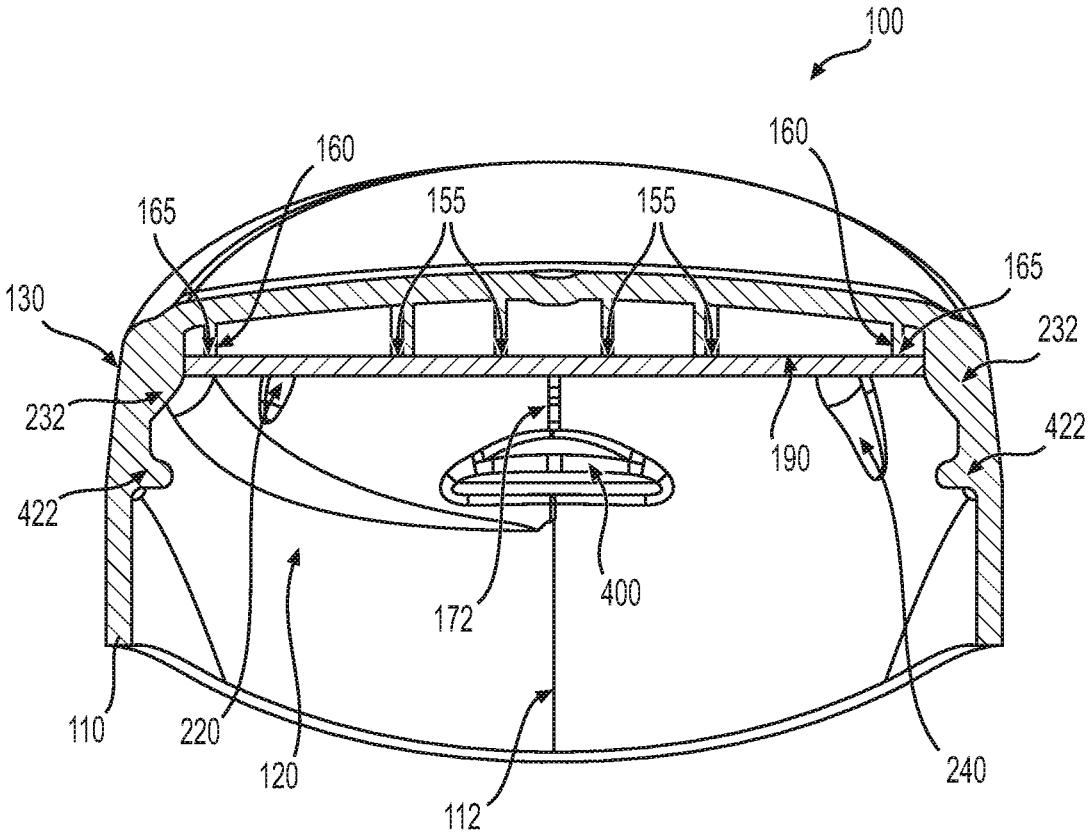
FIG. 13 is a side cross-sectional view taken along line K-K of the cap of FIG. 6, with a liner.

Referring to FIG. 13, second rib 230 has a cross-sectional area 232 and second locking tab 420 has a cross-sectional area 422 taken along line K-K of FIG. 6. Induction liner 190 is shown inserted in cap 100 contacting top surfaces 155 and 165.

Figure 15:
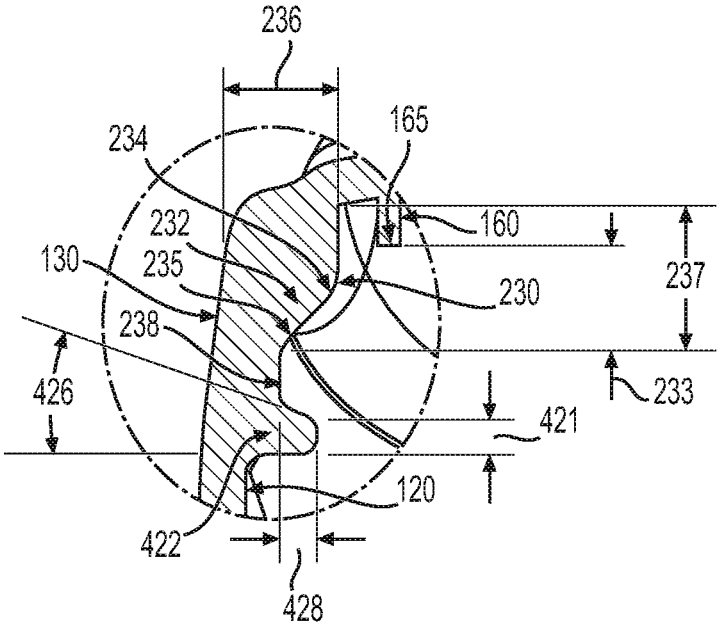
FIG. 15 is a cross-sectional view of a rib taken along line K-K, in the dashed portion of FIG. 14.

Referring to FIG. 15, second rib 230 has a width 236, a height 237 and a concave arc having a radius of curvature 234, and a convex arc having a radius of curvature 235. The concave arc on inner wall 120, represented by the radius of curvature 234, is a circle with a center originating away from inner wall surface 120 and towards outer wall 130. While the convex arc on inner wall 120, represented by the radius of curvature 235, is a circle with a center originating away from outer wall 130 and towards inner wall 120. Also, the bottom of second rib 230 to surface 165, cap 100 is a distance 233.

In the embodiment shown, width 236 is preferably about 2.99 mm, and height 237 is preferably about 4.04 mm. Radius of curvature 234 is preferably about 1.52 mm, and radius of curvature 235 is preferably about 6.35 mm. Also, distance 233 is preferably about 2.92 mm.

Second locking tab 420 has a height 421. Second locking tab 420 protrudes out from surface 238 at a distance 428 and tapers at an angle 426.

In the embodiment shown, height 421 is preferably about 0.97 mm, and distance 428 is preferably about 0.97 mm. Angle 426 is preferably about 20 degrees.

Figure 16:
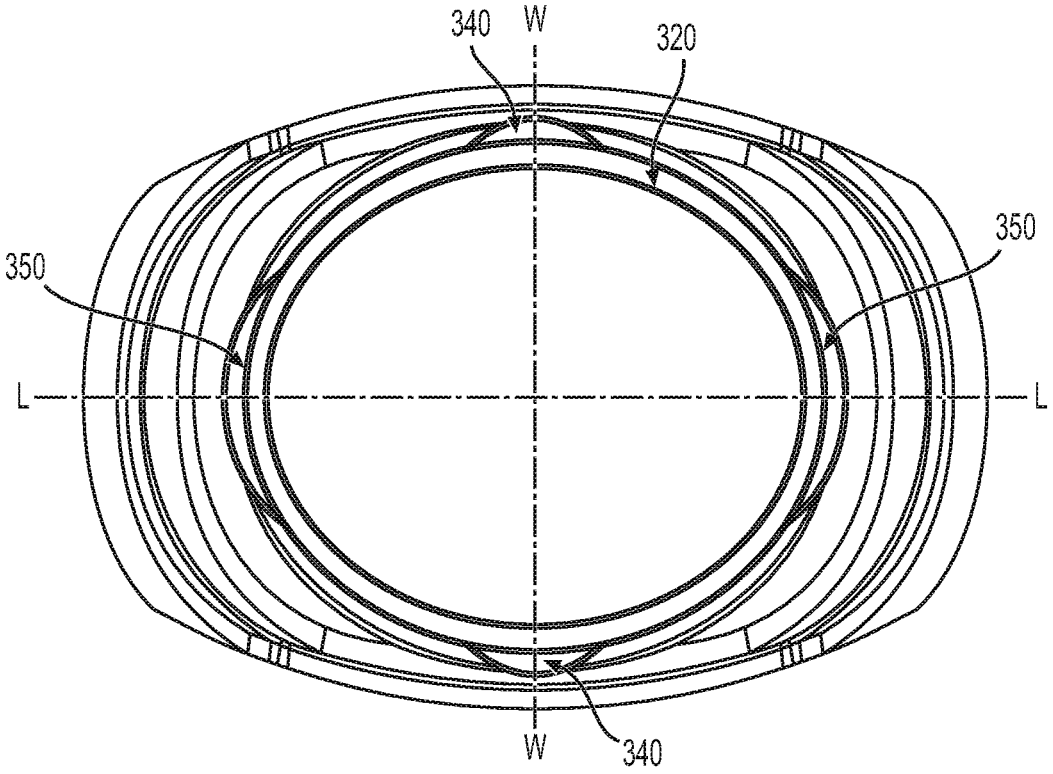
FIG. 16 is a top view of the bottle of FIG. 3.

Referring to FIG. 16, an exemplary bottle 300 that can be used with the cap 100 of the present disclosure is shown. In this embodiment, bottle 300 has a pair of first flanges 340, which are symmetrical about the line L-L, and a second pair of flanges 350, which are symmetrical about the line W-W that protrude from the surface of a neck portion 310 described in FIG. 17.

Figure 17:
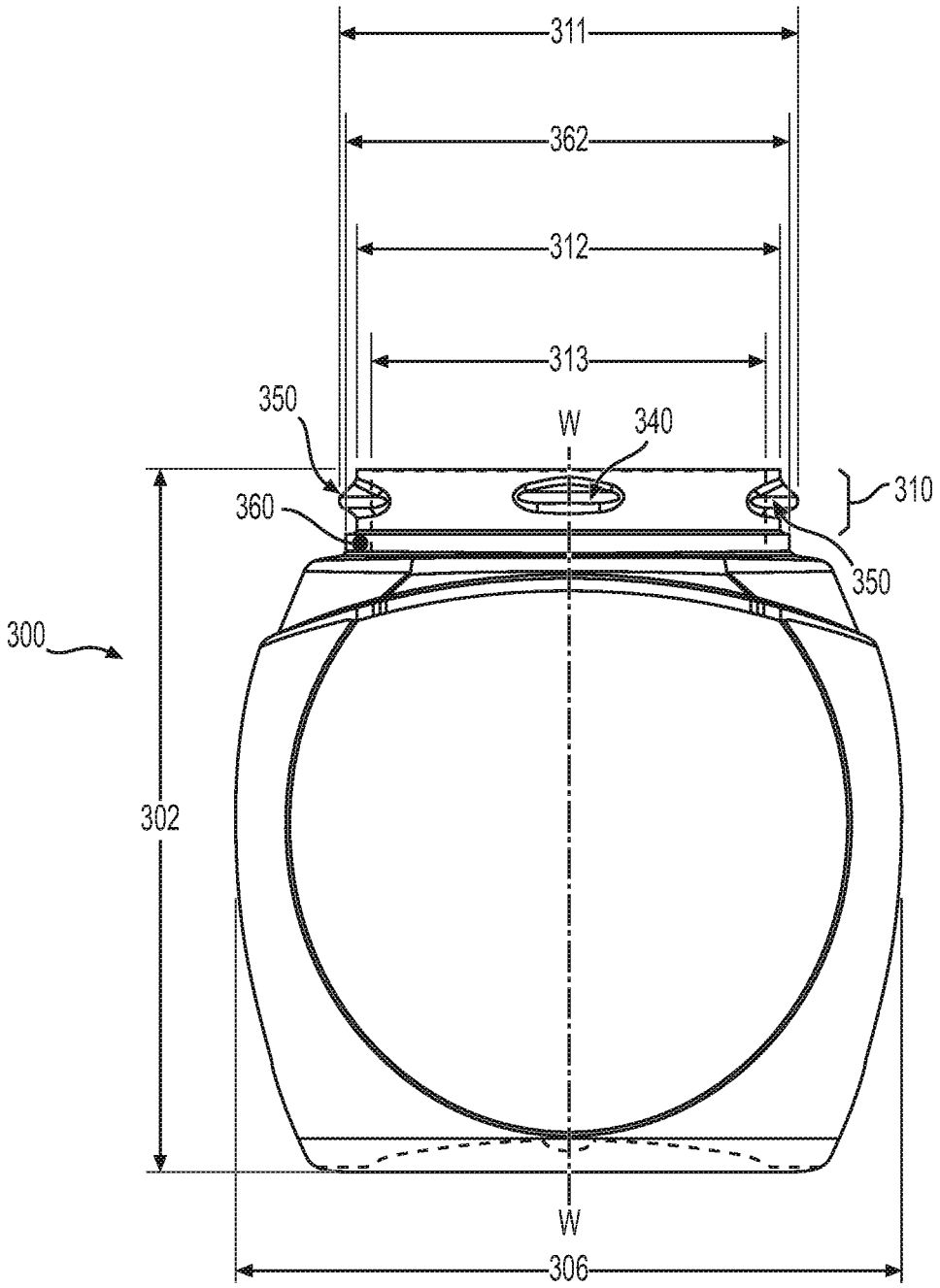
FIG. 17 is a front view of the bottle of FIG. 3.

Referring to the embodiment shown in FIG. 17, bottle 300 has a neck or neck portion 310. Neck portion 310 has a distance 311 measured from the free edges of second flanges 350. Upper neck portion 310 has an oblong opening with a maximum outer dimension 312, and a maximum inner dimension 313. In the embodiment shown, distance 311 is 54.72 mm, maximum outer dimension 312 is 50.42 mm, and maximum inner dimension 313 is 46.99 mm, and all three dimensions are ±0.38 mm.

In the embodiment shown, bottle 300 has a height 302, a maximum width 306, and a base 360 to neck portion 310 with a maximum outer dimension 362. Height 302 is 82.76 mm, and maximum width 306 is 79.29 mm, with both ±0.78 mm. Maximum outer dimension 362 is preferably 52.94 mm.

Figure 18:
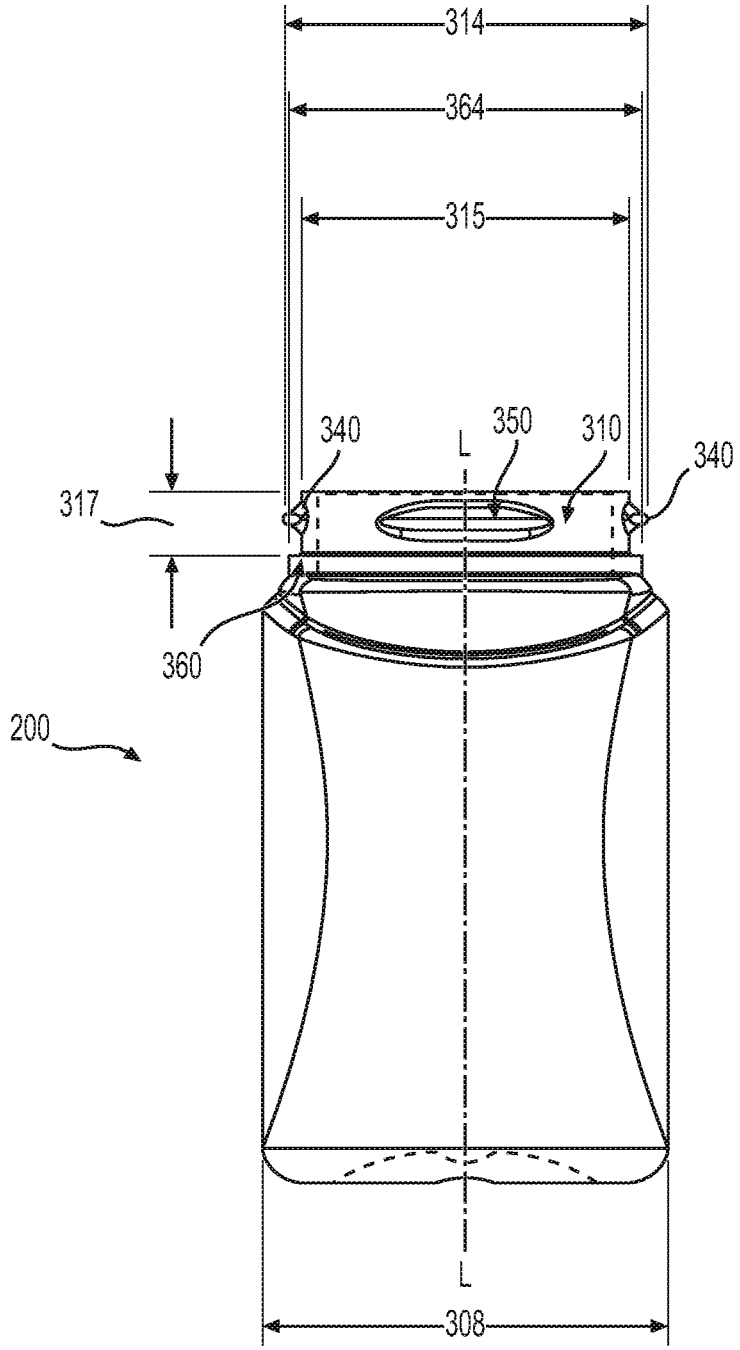
FIG. 18 is a side view of the bottle of FIG. 3.

Referring to FIG. 18, upper neck portion 310 has an outer width 315, and a distance 314 measured from the free edges of first flanges 340. Upper neck portion has a height 317. Base neck portion 360 has a width 364. Bottle 300 has a width 308, of preferably 41.51 mm plus or minus 0.63 mm.

In the embodiment shown, outer width 315 is 33.71 mm and distance 314 is 37.03 mm, each ±0.38 mm. Height 317 is preferably about 7.57 mm. Width 364 is preferably about 36.34 mm.

Figure 19:
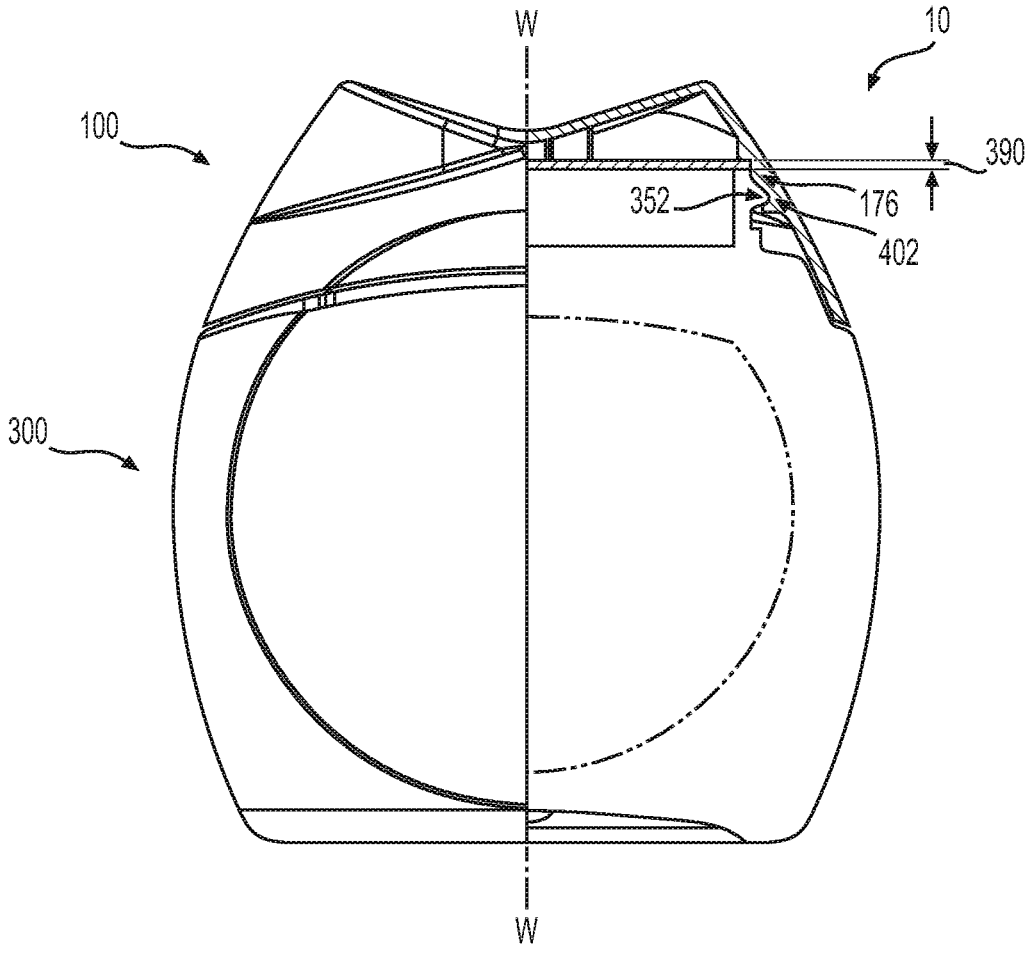
FIG. 19 is a front partial cross-sectional view of the cap and bottle assembly of FIG. 1.
Figure 20:
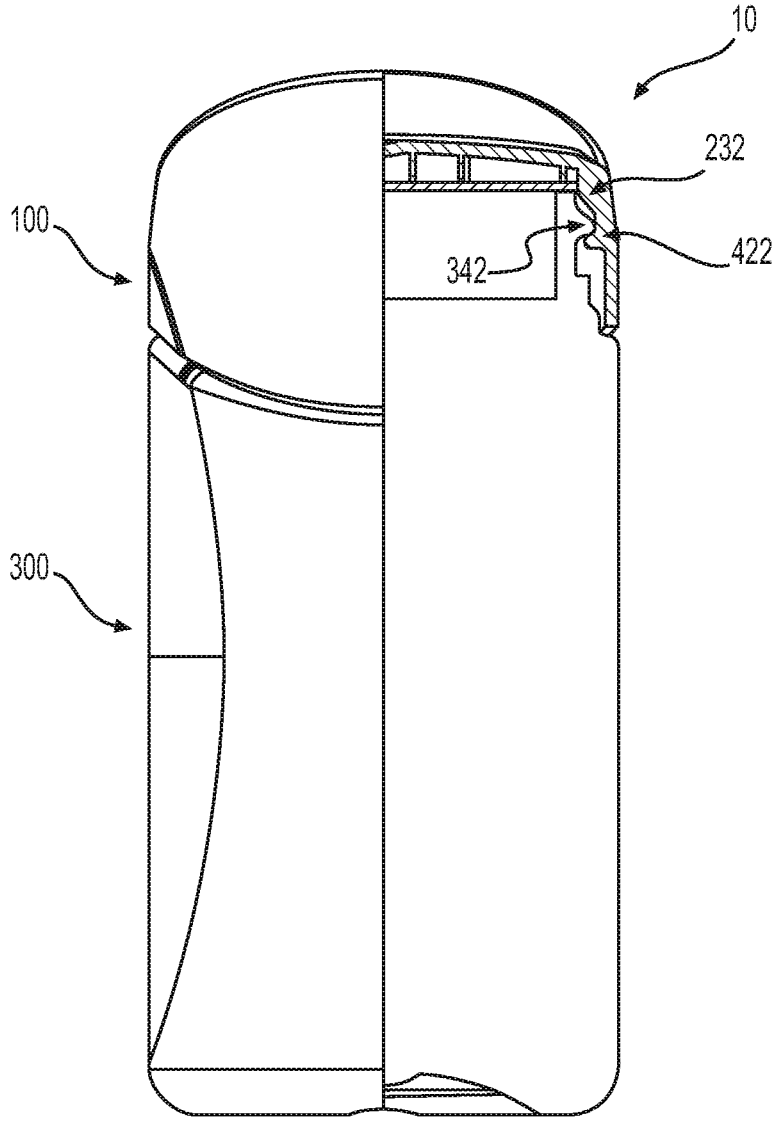
FIG. 20 is a side partial cross-sectional view of the cap and bottle assembly of FIG. 1.

Referring to FIGS. 19 and 20, cap 100 is selectively connectable to bottle 300, when cap 100 is placed on bottle 300, and a downward force on cap 100 is applied, until cap 100 engages onto bottle 300.

FIG. 19 shows a cross-sectional area 352 of one first flange 350, and a cross-sectional area 402 of one first locking tab 400. FIG. 20 shows cross-sectional area 342 of one second flange 340, and a cross-sectional area 422 of one of second locking tab 420.

First locking tab 400 of cap 100 and first flange 350 of bottle 300 engage with each other, and second locking tab 420 and second flange 340 engage with each other as shown to interlock together cap 100 and bottle 300. Gap 390 between cap 100 and bottle 300, shows an area which induction liner 190 is placed in cap 100.

Cap 100 can be selectively disconnected from bottle 300 through application of a twisting force in a predetermined direction on cap 100. The round radius portions of first, second and third ribs 220, 230, and 240, respectively, that can be in contact with portions of bottle 300, prevent breakage of these ribs 220, 230, and 240 when cap 100 is removed from bottle 300 by application of a twisting force.

Furthermore, some embodiments of cap 100 are circular. The round radius characteristics of first and second ribs 220 and 230, respectively, and the round radius and sloping portion of third ribs 240, enable improved retention and application of induction liner 190 into cap 100, while minimizing or even eliminating breakage of the side wall ribs. Further, the application and retention of the liner is improved and there is also an increase in manufacturing efficiency of the aforementioned caps 100. During manufacturing, if a mold is used to create cap 100, the round radius of ribs 220, 230, and 240, prevent or minimize breakage of the ribs when separating the cap from the mold.

In the most preferred embodiment, cap 100 is for a container or bottle 330, and comprises a cap body having an inner wall surface 120 and at least three pairs of ribs 220, 230, 240 distributed on the inner wall surface. Each rib of the at least three pairs of ribs 220, 230, 240 has a concave arc with a concave radius of curvature and a convex arc with a convex radius of curvature. Also, each pair of the at least three pairs of ribs 220, 230, 240 has a different configuration than the other two of the at least three pairs of ribs. This cap embodiment can further comprise a pair of edge ribs 172, and also further comprise a liner 190. The at least three pairs of ribs 220, 230, 240 and the pair of edge ribs 172 secure in place liner 190 in the cap 100.

In this embodiment, the inner wall surface 120 comprises two inner wall surfaces that are joined together with each of the two inner wall surfaces having one rib from each pair of the at least three pairs of ribs 220, 230, 240. It is preferable that all ribs of each pair of the at least three pairs of ribs 220, 230, 240 are equally spaced apart on the inner wall surface 120. This preferred embodiment also further comprises a pair of first locking tabs 400 on the inner wall surface 120. More preferably, one of the pair of edge ribs 172 aligns latitudinally with the pair of first locking tabs 400 on the inner wall surface 120. This preferred embodiment also preferably has a pair of second locking tabs 420 on the inner wall surface 120. Most preferably, each of the second ribs 230 is in the midmost portion of one of the two inner wall surfaces 120.

Further, each locking tab of the pair of first locking tabs 400 has a base and an end and forms a taper therebetween. The taper narrows the locking tab from the base that is closer to the inner wall surface to the end.

This preferred embodiment has a pair of second locking tabs 420 on the inner wall surface 120. One pair 230 of the at least three pairs of ribs 220, 230, 240 aligns latitudinally with the pair of second locking tabs 420 on the inner wall surface 120.

The cap 100 has a cap body with an inner underside surface 140. Inner underside surface 140 has a cup structure

150 centered around the center axis of cap 100 and a circumferential rim 160 extending at a distance from cup structure. Cup structure 150 has a top surface 155 and circumferential rim 160 has a top surface 165. Preferably, top surfaces 155 and 165 are coplanar. The cap 100 can also have a fastening element to connect the top surfaces to liner 190 in cap 100.

It should also be noted that the terms "first", "second", "third", "upper", "lower", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

What is claimed is:

1. A cap comprising:

a. a cap body having a pair of curved side walls and an inner underside surface that are joined or connected together, each curved side wall extending around a center axis of the cap and having an outer wall surface and an inner wall surface, and b. a liner retention system comprising i. a first, second and third pairs of side wall ribs distributed on the inner wall surface, wherein a rib of each pair is positioned on each curved side wall and aligned latitudinally in the cap body, the first, second and third ribs on one side wall facing third, second and first ribs, respectively, on the other side wall, each rib having arcuate surfaces forming a curved structure on the inner wall surface and a curved surface in the latitudinal extant, the curvature helping to retain a liner in the cap, wherein each pair of ribs has a different configuration, and ii. a pair of edge ribs positioned where the pair of curved side walls are joined or connected, and iii. said cap body also comprising first and second pairs of locking tabs distributed on the inner wall surface for engaging with a respective flange on the container, wherein each tab of the first pair is aligned perpendicularly with an edge rib, and each tab of the second pair is aligned perpendicularly with a side wall rib.

2. The cap of claim 1 wherein each tab of the first pair of first locking tabs has a base and an end and forms a taper therebetween, and wherein the taper narrows the locking tab from the base that is closer to the inner wall surface to the end.

3. The cap of claim 1 additionally comprising the liner.

* * * * *